United States Patent [19]

Andrea

[11] 4,147,149

[45] Apr. 3, 1979

[54] EXHAUST VALVE FOR A RECIPROCATING INTERNAL COMBUSTION ENGINE

[75] Inventor: Simon Andrea, Attikon, Switzerland

[73] Assignee: Sulzer Brothers Limited, Winterthur, Switzerland

[21] Appl. No.: 797,237

[22] Filed: May 16, 1977

[30] Foreign Application Priority Data

May 24, 1976 [CH] Switzerland ..... 6506/76

[51] Int. Cl.[2] ..... F01L 3/00; F01P 3/14

[52] U.S. Cl. ..... 123/188 S; 123/41.77

[58] Field of Search ..... 60/272, 282, 304, 305; 123/41.76; 41.77; 188S; 188GC; 193H

[56] References Cited

U.S. PATENT DOCUMENTS

| | | | |
|---|---|---|---|
| 1,659,676 | 2/1928 | Vincent | 123/41.77 |
| 2,517,114 | 8/1950 | Karcher et al. | 123/188 S |
| 4,028,887 | 6/1977 | Tsutsunmi | 60/282 |
| 4,031,699 | 6/1977 | Suga et al. | 60/282 |
| 4,034,723 | 7/1977 | Hamparian | 60/282 |
| 4,046,114 | 9/1977 | Hamparian | 123/41.76 |
| 4,069,667 | 1/1978 | Date et al. | 60/282 |

FOREIGN PATENT DOCUMENTS 2550781 5/1977 Fed. Rep. of Germany.

*Primary Examiner*—Charles J. Myhre
*Assistant Examiner*—David D. Reynolds
*Attorney, Agent, or Firm*—Kenyon & Kenyon Reilly Carr & Chapin

[57] ABSTRACT

The exhaust valve is provided with an air gap which extends axially of a sleeve-like member to which the hot exhaust gases from the combustion chamber passes. The air gap serves to impede heat exchange between the coolant which cools the valve seat surface of the sleeve-like member and the hot gases passing over the inner surface of the sleeve-like member.

4 Claims, 4 Drawing Figures

Fig. 2
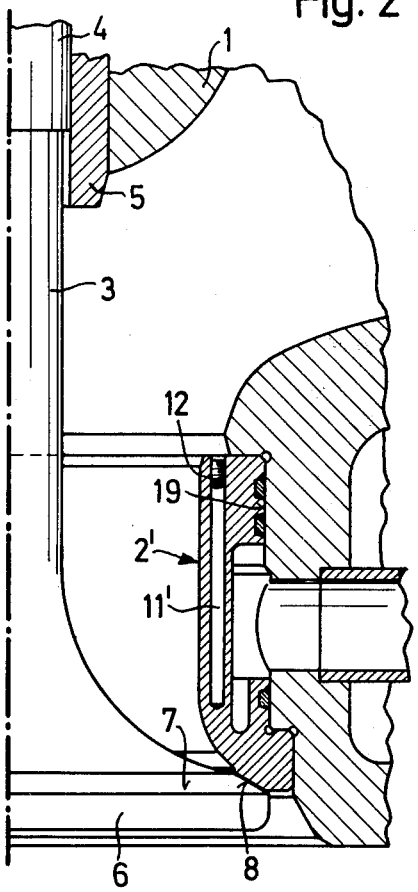
Fig. 3
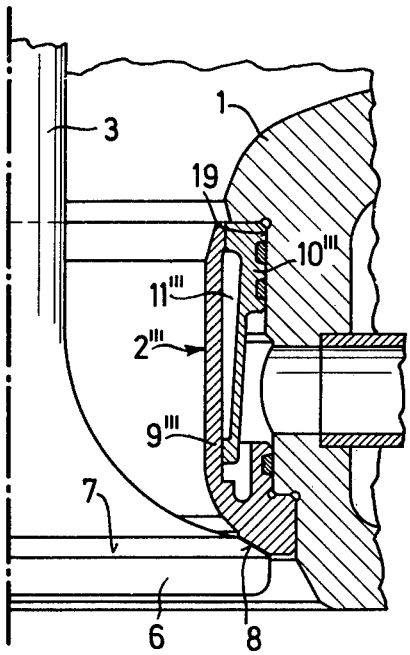
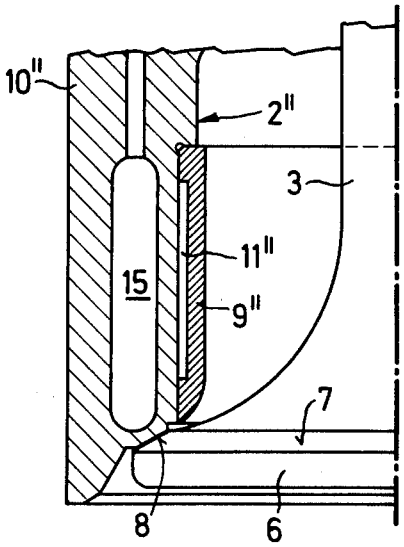
Fig. 4

EXHAUST VALVE FOR A RECIPROCATING INTERNAL COMBUSTION ENGINE

This invention relates to an exhaust valve for a reciprocating internal combustion engine.

As is known, exhaust valves for reciprocating internal combustion engines generally have a moving part such as a valve body which reciprocates within a liner-like or sleeve-like member on which a valve seat surface is formed and which is secured in the cylinder head. Generally, the valve seat surface of such a sleeve-like member is cooled by a liquid coolant which passes through chambers within the sleeve-like member or through a cylinder head in which the sleeve-like member is mounted.

However, in exhaust valves of this kind, the gases leaving the cylinder combustion chamber may be cooled to such a degree by the liquid coolant after passing the valve seat that the temperature of such gases drops below their dew point. This usually leads to corrosion in the engine parts through which the gases flow after passing by the valve.

Accordingly, it is an object of the invention to insure that the gases flowing downstream of a valve seat of an exhaust valve remain at temperatures above their dew point.

It is another object of the invention to provide a simple means of impeding the cooling of hot combustion gases flowing through an exhaust valve of a reciprocating internal combustion engine.

It is another object of the invention to provide an exhaust valve with a valve seat member which permits cooling of a valve seat surface via a coolant without appreciably cooling the inner surface of the member.

Briefly, the invention provides an exhaust valve for a reciprocating internal combustion engine having a cylinder head and a combustion chamber. The exhaust valve is constructed with a movable valve body having a sealing surface and a sleeve-like member having a valve seat surface at one end for matingly receiving the sealing surface of the valve body in seal-tight relation. The sleeve-like member also has an inner surface which extends axially of the member for guiding a flow of gases, e.g. hot combustion gases from the combustion chamber, through the member. In addition, at least one narrow air gap extends axially within the member between the valve seat surface and the inner surface of the member.

A means is also provided for passing a coolant through the cylinder head to cool the valve seat surface of the sleeve-like member. To this end, the sleeve-like member may have at least one chamber adjacent the valve seat surface for passage of the coolant.

The narrow air gap of the sleeve-like member is positioned outside the cooling zone of the valve seat surface to impede heat exchange between the flow of gases over the inner surface of the sleeve-like member and the coolant. This constructionally simple feature ensures, first, that the requisite cooling of the valve seat surface of the sleeve-like member is retained and, second, that cooling of the gases flowing along the member downstream of the seat surface is so limited that the temperature of the gases definitely remains above the dew point. There is therefore no condensation of acids which might cause corrosion in the flow paths after the exhaust valve.

In one embodiment, the sleeve-like member is formed of two coaxial tubular parts having rotationally symmetrical opposed surfaces defining the air gap. In this embodiment, the inner part may form the inner surface over which the combustion gases passes while the outer part forms the valve seat surface or, the inner part may form both the inner surface and the valve seat surface.

In another embodiment, the sleeve-like member is a unitary body and has a plurality of axial passages forming a plurality of air gaps distributed peripherally of the member to impede heat exchange.

These and other objects and advantages of the invention will become more apparent from the following detailed description and appended claims taken in conjunction with the accompanying drawings in which:

FIG. 2 illustrates a partial cross-sectional view of a modified exhaust valve according to the invention;

FIG. 3 illustrates a partial cross-sectional view of a further modified exhaust valve according to the invention; and FIG. 4 illustrates a partial cross-sectional view of an exhaust valve according to the invention having a sleeve-like member in the form of a valve cage.

Figure 1:
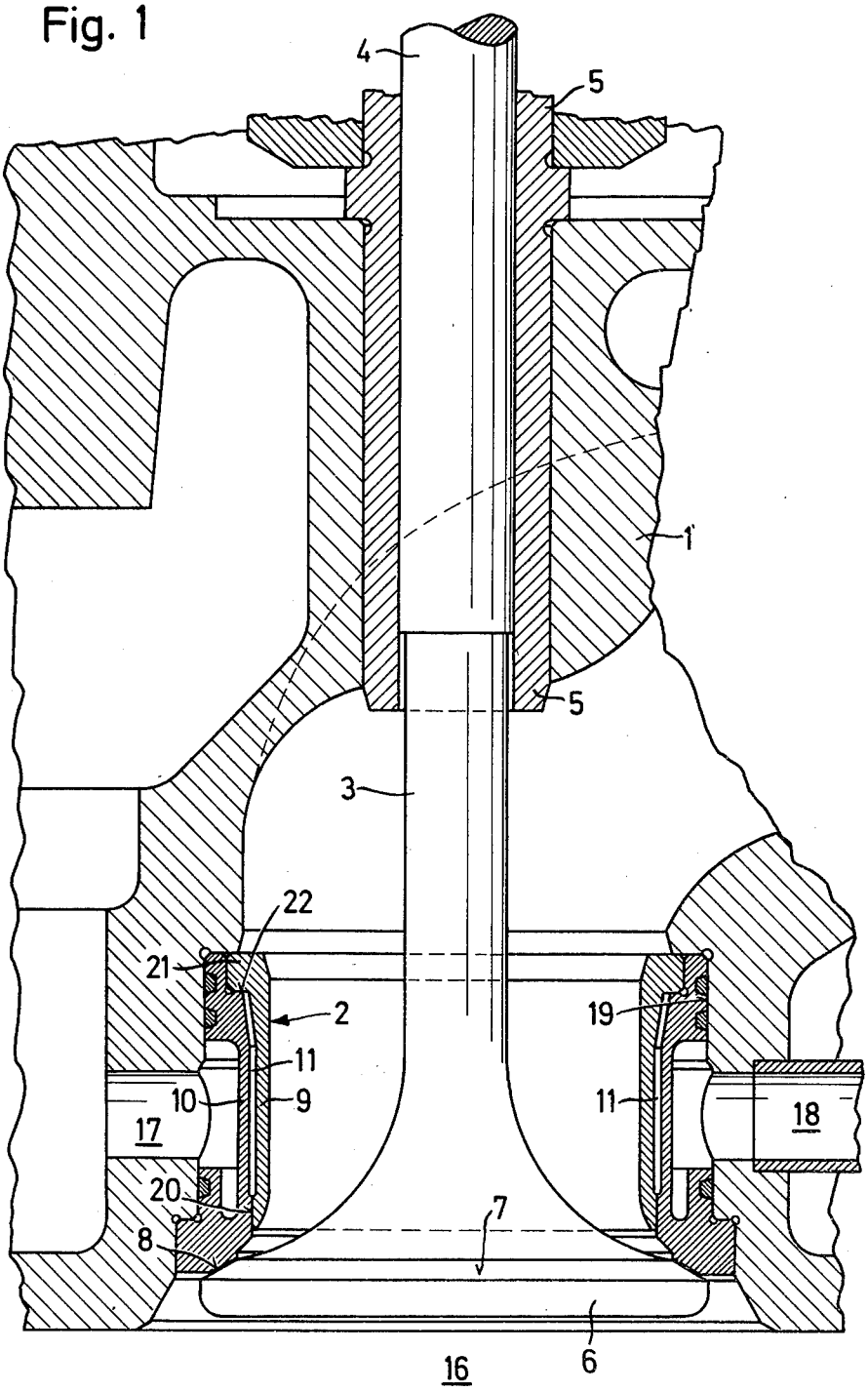
FIG. 1 illustrates a cross-sectional view of an exhaust valve constructed in accordance with the invention in a reciprocating internal combustion engine.

Referring to FIG. 1, the reciprocating internal combustion engine has a water-cooled cylinder head 1 and a combustion chamber 16 of known construction. In addition, a plurality of exhaust valves, only one of which is shown for simplicity, are each mounted in the head 1.

Each exhaust valve has a movable valve body 3 or the like which is reciprocally mounted for axial displacement via a stem 4 in a sleeve 5 secured in the head 1. The valve body 3 has a plate-like portion 6 at the lower end as viewed, which carries a conical sealing surface 7. In addition, the exhaust valve has a sleeve-like member 2 secured in a recess 19 of the cylinder head 1 to cooperate with the valve body 3. To this end, the sleeve-like member has a valve seat surface 8 at one end for matingly receiving the sealing surface 7 of the valve body 3 in seal-tight relation in the closed position illustrated.

In addition, a means is provided in the form of ducts 17, 18 for passing a liquid coolant, such as cooling water, through the head 1 to cool the valve seat surface 8. These ducts 17, 18 communicate with the recess 19 in which the sleeve-like member 2 is mounted so that the coolant acts on the outside of the member 2. Also, the sleeve-like member 2 has at least one chamber adjacent the valve seat surface 8 and in communication with the recess for passage of the coolant.

As shown in FIG. 1, the sleeve-like member 2 is composed of two coaxial tubular parts 9, 10 which engage in each other and which have rotationally symmetrical opposed surfaces defining a narrow air gap 11. The outer part 10 is secured in the cylinder head 1 via flanges at each end. The lower flange, as viewed form the valve seat surface 8 while the inner part 9 forms an inner surface over which hot combustion gases may pass from the combustion chamber 16 through the member 2. The inner part 9 also has an exterior cylindrical portion 20 at the lower end, as viewed, which engages with a cylindrical inside surface of the outer part 10. The opposite end of the inner part 9 has an external flange-like thickening 21 which rests on an annular step or shoulder 22 in a correspondingly shaped recess in the outer part 10. The cylindrical portion 20 and thickening 21 define the axial limits of the air gap 11. As shown, the air gap 11 extends axially up to near the top and then extends in a slightly conical fashion to the thickening 21. The air gap 11 is continuous around the periphery of the member 2.

The parts 9, 10 can be interconnected by brazing or welding or be so dimensioned as to be adapted to be pressed into one another and be virtually sealing-tight near the parts 20, 21.

The air in the air gap 11 is stagnant and therefore provides heat insulation between, on the one hand, the hot gases leaving the cylinder combustion chamber 16 and passing over the inner surface of the member 2 and, on the other hand, the cooling water which comes from the cooling chambers of the cylinder head 1 and which flows on the outside surface of the member 2. That end of the gap 11 which is at the bottom in FIG. 1 is disposed outside the cooling zone of the seat surface 8 provided by the cooling water.

During use, there is intensive cooling of the seat surface 8 of the member 2. However, the air gap 11 ensures that the gases downstream of the surface 8 are not cooled excessively and that their temperature does not drop below the dew point. Dew point corrosion near the cylinder head is therefore obviated.

Referring to FIG. 2, wherein like characters indicate like parts as above, the sleeve-like member 2' can be made as a unitary body. As in FIG. 1, the member 2' is secured in a recess 19 in the cylinder head 1. The member 2' experiences the cooling water flowing in the cylinder head 1 on the outside, as in the case shown in FIG. 1, the cooling effect being directed to the valve seat surface 8. In this embodiment, there are a plurality of air gaps 11' in the member 2' and they take the form of axial passages or bores. The bores 11' start from that end of the member 2' distal from the surface 8, extend over some three-quarters of the axial length of member 2', and are closed by a screwthreaded plug 12 at the distal end. As considered in the peripheral direction of the member 2', the axial bores 11' are disposed on a circle concentric to the axis of the member 2'. Alternatively, the bores 11' can be disposed in staggered relationship on two concentric circle lines, provided that the wall thickness of the member 2' is sufficient to permit this.

Referring to FIG. 3, the sleeve-like member 2''' may also be embodied by two coaxial tubular parts 9''', 10''' wherein the valve seat surface 8 is provided on the inner part 9''' along with the inner surface over which the combustion gases can flow. The air gap 11''' with its stagnant air is disposed between the parts 9''', 10''' and reduces heat exchange between the gases flowing along the inside part 9''' and the cooling water flowing in the cylinder head 1, to obviate condensation of acids downstream of the valve seat surface 8. As shown, the air gap 11''' is spaced from the cooling zone of the valve seat surface 8 so that, despite the air gap 11''', the valve seat surface 8 is intensively cooled by the cooling water.

Referring to FIG. 4, the sleeve-like member 2'' may alternatively take the form of a valve cage or basket 10'' having a coaxial tubular part 9'' on the inside. In this case, the valve cage 10'' may have a valve seat surface 8 near the lower end as viewed and may be formed with an annular cavity 15 to which supply and removal ducting for cooling water is connected in a manner not shown in greater detail. The air gap 11'' for impeding heat exchange is disposed between the outside boundary surface of the inner part 9'' and the adjacent surface of the valve cage 10''. This gap 11'' can be formed by removing material from the outside surface of the part 9'', e.g. by turning machining. This embodiment also provides intensive cooling of the valve seat surface 8 of the valve cage 10'', but the stagnant air trapped in the gap 11'' serves to reduce heat exchange and thus prevent excessive cooling of the gases above the valve seat surface 8. The temperature of such gases therefore remains above the acid dew point.

What is claimed is:

1. In an exhaust for mounting in a cylinder head of a reciprocating internal combustion engine, the combination comprising a movable valve body having a sealing surface thereon;

and a sleeve-like member composed of two coaxial tubular parts, an outer one of said parts having a flange at each end for securement in the cylinder head, one of said flanges defining a valve seat surface for matingly receiving said sealing surface of said valve body in seal-tight relation and at least one chamber adjacent said valve seat surface for passage of a coolant to cool said valve seat surface and an outside surface of said outer part, the inner one of said parts having an inner surface extending axially of said member for guiding a flow of gases through said member and defining at least one narrow closed air gap extending axially between said parts between said valve seat surface and said inner surface and outside a cooling zone of said valve seat surface to impede heat exchange between the flow of gases and the coolant.

2. In combination with a reciprocating internal combustion engine having a cylinder head and a combustion chamber, an exhaust valve comprising a moveable valve body reciprocally mounted in said cylinder head and having a sealing surface thereon; and a sleeve-like member mounted in said cylinder head adjacent said combustion chamber, said member having a pair of coaxial tubular parts, an outer one of said part having a valve seat surface at one end for matingly receiving said sealing surface of said valve body in seal-tight relation and an annular chamber adjacent said valve seat surface, the inner one of said parts having an inner surface extending axially of said member for guiding a flow of hot combustion gases from said combustion chamber through said member and defining at least one narrow closed air gap extending axially between said parts and between said valve seat surface and said inner surface; and means for passing a coolant through said cylinder head to cool said valve seat surface and said chamber of said outer part with said air gap impeding heat exchange between the flow of hot combustion gases over said inner surface and the coolant.

3. In an exhaust valve for a reciprocating internal combustion engine, the combination comprising a movable valve body having a sealing surface thereon; and a sleeve-like unitary body having a valve seat surface at one end for matingly receiving said sealing surface of said valve body in seal-tight relation, at least one chamber adjacent said valve seat surface for passage of a coolant to cool said valve seat surface, an inner surface extending axially of said member for guiding a flow of gases through said member, and a plurality of axial passages defining narrow air gaps extending axially within and peripherally of said unitary body between said valve seat surface and said inner surface and outside a cooling zone of said valve seat surface to impede heat exchange between the flow of gases and the coolant.

4. In combination with a reciprocating internal combustion engine having a cylinder head and a combustion chamber, an exhaust valve comprising a movable valve body reciprocally mounted in said cylinder head and having a sealing surface thereon; and a sleeve-like unitary body mounted in said cylinder head adjacent said combustion chamber, said unitary body having a valve seat surface at one end for matingly receiving said sealing surface of said valve body in seal-tight relation, an inner surface extending axially of said member for guiding a flow of hot combustion gases from said combustion chamber through said member, and a plurality of axial passages defining narrow air gaps extending axially within and peripherally of said unitary body between said valve seat surface and said inner surface; and means for passing a coolant through said cylinder head to cool said valve seat surface of said sleeve-like unitary body with said air gaps impeding heat exchange between the flow of hot combustion gases over said inner surface and the coolant.

* * * * *